US007784408B2

(12) United States Patent
Müller

(10) Patent No.: US 7,784,408 B2
(45) Date of Patent: Aug. 31, 2010

(54) RIDE

(75) Inventor: Alfred Müller, Gröbenzell (DE)

(73) Assignee: Maurer Söhne GmbH & Co. KG, Munich (DE)

( * ) Notice: Subject to any disclaimer, the term of this patent is extended or adjusted under 35 U.S.C. 154(b) by 163 days.

(21) Appl. No.: 12/170,394

(22) Filed: Jul. 9, 2008

(65) Prior Publication Data

US 2009/0013895 A1 Jan. 15, 2009

(30) Foreign Application Priority Data

Jul. 10, 2007 (EP) ..... 07112200

(51) Int. Cl.
*A63G 1/00* (2006.01)

(52) U.S. Cl. ..... 104/55; 104/56; 104/57

(58) Field of Classification Search ..... 104/53, 104/55–57, 60, 63–66
See application file for complete search history.

(56) References Cited

U.S. PATENT DOCUMENTS

| | | | | |
|---|---|---|---|---|
| 4,165,695 | A * | 8/1979 | Schwarzkopf | 104/55 |
| 4,831,937 | A * | 5/1989 | Yamada | 104/56 |
| 5,433,153 | A * | 7/1995 | Yamada | 104/63 |
| 5,463,962 | A * | 11/1995 | Gnezdilov | 104/55 |
| 6,158,354 | A * | 12/2000 | Eiraku | 104/53 |
| 6,629,500 | B1 * | 10/2003 | Hansen | 104/53 |

(Continued)

FOREIGN PATENT DOCUMENTS

| | | | |
|---|---|---|---|
| DE | 8614009 | U1 | 7/1986 |

(Continued)

*Primary Examiner*—S. Joseph Morano
*Assistant Examiner*—Jason C Smith
(74) *Attorney, Agent, or Firm*—Pai Patent & Trademark Law Firm; Chao-Chang David Pai

(57) ABSTRACT

A ride in particular for amusement parks, comprising: a drive track, comprising a guide device (3) for guiding at least one vehicle (2) along said guide device (3) in a movement direction (v); at least one vehicle (2), comprising a normal vector (n), fixated relative to the vehicle (2) and oriented perpendicular to the movement direction (v); and a drive pattern (1), comprising at least a first track section (5, 6), comprising an incline/decline, and a second track section (8, 9), comprising an incline/decline, comprising a prefix, which is inverse to the prefix of the incline/decline of the first track section (6, 7), wherein the first track section (6, 7) and the second track section (8, 9) are connected amongst one another, forming at least a partial section of a loop, wherein the guide device (3) is configured, so that the normal vector (n) in the first track section (6, 7) is rotated from an orientation to the outside or to the inside with reference to the loop at the entry into the first track section (6, 7) through a rotation of the normal vector (n) about an axis parallel to the movement direction (v) into an orientation to the inside or the outside, and the normal vector (n) in the second track section (8, 9) is rotated from the orientation to the inside or to the outside back to an orientation to the outside or to the inside, wherein the guide device (3) is furthermore configured, so that the normal vector (n) of the vehicle (2), when passing through the drive pattern (1), is not oriented upward, so that the vehicle does not assume an overhead position at any location in the drive pattern (1).

13 Claims, 5 Drawing Sheets

U.S. PATENT DOCUMENTS 6,792,873 B1 * 9/2004 Gnezdilov ..... 104/53
6,857,373 B2 * 2/2005 Checketts et al. ..... 104/53
7,351,154 B2 * 4/2008 Muller et al. ..... 472/43
2005/0288109 A1 * 12/2005 Muller et al. ..... 472/43
2009/0013895 A1 * 1/2009 Muller ..... 104/55

FOREIGN PATENT DOCUMENTS

DE 20306748 U1 10/2003

* cited by examiner

RIDE

BACKGROUND OF THE INVENTION

1. Field of the Invention

The invention relates to a ride, in particular for amusement parks and similar, comprising: a drive track, comprising a guide device for guiding at least one vehicle along the guide device in a movement direction; at least one vehicle, comprising a normal vector which is perpendicular to the movement direction and fixated relative to the vehicle and; and a drive pattern, comprising at least a first track section, comprising an incline/decline and a second track section, comprising an incline/decline with a prefix that is opposite to prefix of the incline/decline of the first track section, wherein the first track section and the second track section are connected amongst one another, forming at least a partial section of a loop.

2. Description of the Prior Art

In amusement parks, carnivals, town fairs, etc., different types of rides are being offered. High-speed rides, like e.g. roller coasters, are thus particularly popular.

State of the art roller coasters comprise a drive track, comprising drive patterns. The vehicles are typically arranged e.g. as trains and moved on the rails along the drive track. The passengers typically sit in the vehicles.

The drive patterns typically comprise a plethora of possible track paths. The enjoyment of the ride is enhanced in particular by special curve paths, inclines, declines, or inversions. In order to enhance the attraction and the suspense, there is ongoing technology development, e.g. drive technology development on the one hand. On the other hand, new drive patterns are developed all the time, in order to increase the diversity of the ride.

So-called overhead figures or inversions have been particular attractions for quite a while. In these patterns, the head of a passenger, received in the vehicle, points towards the earth surface, at least for a short period of time. Popular inversions are loopings, in which the vehicle passes through the inside of a substantially vertically aligned loop, or corkscrew movements, in which the vehicle is rotated downward by 180° about an axis parallel to the movement direction, while passing through a certain track section.

Passing through a looping, besides providing a short time overhead position of the passengers, causes strong centrifugal forces in the direction of the normal vector of the vehicle, and covers a substantial elevation difference quickly, which leads to a particular driving sensation.

Such overhead figures and inversions, however, require increased safety measures, in particular overhead safety devices, so that the passengers received in the vehicles, on the one hand, are safely held in an overhead position in the vehicle. On the other hand, it has to be avoided that a vehicle comes to a standstill in an overhead position. Furthermore suitable measures have to be taken, so that the vehicle does not roll along the track in an uncontrolled manner, e.g. when the drive system or the brakes fail.

Should a vehicle stop in an overhead position anyhow due to an undesirable event, particular measures for evacuating the passengers have to be taken, since the exposure time in said position is very limited for health reasons.

Furthermore, overhead elements rather appear deterring than attractive, compared to non-inverted elements, for some of the viewers when viewed from the outside. For example, in rides, which appeal to a larger audience, like the entire family, inversions are left out. Furthermore, there are more stringent restrictions with respect to the age and the height of children.

The additional safety measures, however, imply, that the ride becomes technically more complex overall, and greater acquisition costs and maintenance costs are incurred. This, however, is widely accepted, since an exciting driving sensation is to be conveyed in order to increase the attractiveness of the ride.

BRIEF SUMMARY OF THE INVENTION

Object of the Invention

With this background, it is the object of the present invention to provide a ride, where the complexity of safety systems can be reduced, while the enjoyment of the ride is still unrestricted, and which provides an attractive appearance in spite of not comprising overhead patterns.

Technical Solution

A ride according to the invention in particular for amusement parks and similar comprises: a drive track, comprising a guide device for guiding at least one vehicle along the guide device in a movement direction; at least one vehicle, comprising a normal vector perpendicular to the movement direction and fixated relative to the movement direction; and a drive pattern, comprising at least a first track section, comprising an incline/decline, and a second track section, comprising an incline/decline with a prefix, which is opposite to the prefix of the incline/decline of the first track section, wherein the first track section and the second track section are connected amongst one another and form at least a partial section of a loop. The guide device is configured, so that the normal vector is rotated in the first track section from an orientation pointing outward or inward with respect to the loop, when entering the first track section, through a rotation of the normal vector about an axis, which is parallel to the movement direction, into an orientation pointing towards the inside or the outside, and the normal vector is rotated in the second track section from an orientation pointing towards the inside or the outside into an orientation pointing towards the outside or the inside, wherein the guide means is furthermore configured, so that the normal vector of the vehicle, when passing through the drive pattern, is not aligned upward relative to horizontal, so that the vehicle does not enter an overhead position at any location of the drive pattern.

A ride with a new drive pattern is proposed, which can comprise a track path similar to a loop. The track pattern is substantially determined by the movement direction of a vehicle along the guide means. The term "track path" means in the context of this patent application, that rotations (lateral movements/tilting) of the vehicle about an axis parallel to the movement direction or about an axis coinciding with the movement direction are determined by the configuration of the track, however, the track path with one degree of freedom is only determined by the movement direction along the guide device. The movement direction thus extends tangential to the track pattern. All movement directions form a group of tangents along the loop included in the drive pattern. Overall, the appearance of the driving pattern, which is defined by the guide device, can be similar to a cycloid, an oval, or a circle.

A loop according to the present patent application is any track pattern, which defines a closed drive pattern, comprising an inside and an outside, in a side view or in a lateral projection. Thus, closed or all conceivable open loops with end sections extending offset to one another are included.

The loop is in particular approximately vertically oriented. The track pattern can e.g. substantially define a looping.

However, while a conventional looping is traveled by a vehicle on the inside with a normal vector always pointing outward, a vehicle enters and exists the looping type loop according to the invention at its inside, however, without performing an inversion/overhead position between the entry and exit. In a conventional looping, initially an incline is passed through, which transitions into an overhead section and subsequently a decline is passed through.

Any position of the vehicle in which the head of a passenger correctly received in the vehicle points downward at a slant in the direction of the earth surface is considered an overhead position or an inversion. The invention is thus based on the finding that such overhead positions or inversions of the vehicles going through the driving pattern can be avoided by a rotation of the normal vector about an axis parallel to the movement direction of the vehicle, or about an axis, which coincides with the movement direction of the vehicle. Thus, this means a lateral rotation of the vehicle about an axis, which is tangential to the track path, this means about a longitudinal axis of the vehicle. While the cart is positively guided by the guide device, and the guide device allows a movement with one degree of freedom along the guide device, the rotation of the vehicle in a plane perpendicular to the movement direction is forced by the guide device. Therefore, the guide device is e.g. wound, in order to change the direction of the normal vector of the vehicle when passing through a partial section of the driving pattern. The vehicle can thus perform e.g. a helical movement, which facilitates that the vehicle, which enters the drive pattern on the inside of the loop, is rotated transversal or perpendicular to the track path, so that the vehicle continues its movement at the outside of the loop.

By avoiding inversions, substantial savings can be accomplished with respect to the provision of safety devices without degrading the attractiveness of the ride. Furthermore, the target audience of possible passengers is increased, since the non-inverted element according to the invention in contrast to the inversion provides more flexibility with respect to the age and the height of the passengers.

The guide device can preferably be configured, so that the normal vector of the vehicle substantially points vertically downwards towards the earth surface in a track point between the first track section and the second track section. Thus, the transition point can e.g. be an apex of a curved track section, which is open in upward or in downward direction. The vehicle is in a "normal position" at this track point, this means in a substantially horizontally aligned, non-inverted position.

The track point between the first track section and the second track section thus forms in particular an absolute and/or relative high point or an absolute and/or relative low point of the drive pattern.

The drive pattern preferably comprises an entry section and/or an exit section, wherein the guide device in the entry section and/or in the exit section is configured, so that the normal vector of a vehicle passing through the respective section substantially points downward towards the earth surface. This way, the entry and the exit are configured like in a conventional looping.

The guide device can be configured in particular, so that a vehicle passing through the first track section is rotated in a first rotation direction about an axis parallel to the movement direction of the vehicle, a vehicle passing through the second track section is rotated in a second rotation direction about an axis parallel to the movement direction of the vehicle, wherein the first rotation direction and the second rotation direction are identical or opposite. A rotation of the vehicle in the context of the present invention means a lateral rotation of the normal vector of the vehicle.

Overall, the rotation direction is selected, so that the normal vector of the vehicle always points downward vertically or at a slant angle. By all means, the normal vector at least never points substantially upward. It is appreciated by a person skilled in the art, which direction of rotation he has to choose for a particular configuration of a loop.

The track path within the drive pattern is configured in particular, so that the movement direction at the beginning of the first track section is oriented in particular at an angle of approximately 180° opposite to the movement direction at the end of the first track section, and/or the movement direction at the beginning of the second track section is oriented in particular at an angle of approximately 180° opposite to the movement direction at the end of the second track section.

The first track section can comprise a first partial track section and a second partial track section, which form a substantially semicircular track path when they are connected amongst one another, and/or the second track section comprises a third partial track section and a fourth partial track section, which form a substantially semicircular track path when they are connected amongst one another.

In the first partial section, the normal vector of the vehicle is substantially oriented towards the interior of the loop or towards the exterior of the loop. The transition between the first partial section and the second partial section constitutes a transition point, in which the normal vector of a vehicle changes its direction and points towards the exterior or towards the interior with respect to the loop. The same holds for the third and fourth partial sections, whose transition is also characterized by a change of the orientation of the normal vector towards the interior or the exterior of the loop. In the transition points, the vehicle typically reaches its steepest orientation while passing through the entire drive pattern. However, at the most, the vehicle reaches a vertical incline; this means a horizontal orientation of the normal vector.

The guide device is preferably configured, so that a vehicle passing through the first partial section and/or the second partial section and/or the third partial section and/or the fourth partial section is rotated respectively by an angle between 75° and 105°, in particular by an angle of 90°.

In the context of the invention deviations from 90° rotation angles are certainly conceivable in particular sections or in all sections of the drive pattern, wherein said deviations result from a non-horizontal entry into the looping and cause a non-horizontal passage through the apex point and similar.

The guide device is configured in particular, so that the drive track is tilted relative to a perpendicular in a plane defined by the movement direction and the normal vector in the transition portion from the first partial track section to the second partial track section and/or from the third partial track section to the fourth partial track section.

The first and the second track section of the looping or the loop are basically laterally tilted at least in the transition portion between the partial track sections, so that the vehicle during a transition between the partial track sections does not perform a vertical movement in upward or downward direction, but only a movement at a slant angle. The term "lateral" relates to the plane, in which, or around which the movement orientation vectors are disposed in groups at small angles relative to the plane. Tilt angles relative to vertical can thus be in particular less than 15°, less than 30°, or less than 45°. The tilt angle is the smaller angle between the vertical and the velocity vector of the vehicle at said positions. Certainly, also a transition without tilting, thus vertically upward or downward is possible.

A tilt angle, which is at least slight, can be necessary or useful in order to compensate for the lateral forces acting upon the passenger. The minimum base width of the drive pattern is determined by passing through the drive pattern without endangering the passengers. The slightly tilted position can also be caused by the fact that a track offset between the entry and the exit of the loop or the looping exists.

The tilt angle typically also determines the maximum angle, which the normal vector of the vehicle assumes relative to the vertical, while passing through the drive pattern. Typically, said maximum angle is determined by the tilt angle, wherein the angle between a horizontal and the normal vector corresponds to the tilt angle in the transition portion between the partial track sections. Because of the lateral tilt, the ascent/descent of the vehicle is less steep, when driving on the side of the drive track.

The first track section can inclined in a particular embodiment and the second track section can be declined, and the first and the second track section can form a track path in the form of a looping. In parallel or offset to one another, an entry section and an exit section can be disposed, which are connected to the first track section, or to the second track section. Said sections can extend horizontally in particular.

In another embodiment, the first track section can form a declined track section, and the second track section can form an inclined track section, and the first track section and the second track section can form a portion of the loop of the drive pattern. The first and the second track section are components of the loop. The loop is completed by a declined exit section. The entry is preferably performed by a substantially horizontal entry section, which is disposed in front of the first track section.

The ride preferably does not comprise overhead and/or inversion track sections over its entire drive track.

Such a ride has the advantage that no safety devices have to be provided for overhead driving and inversions. Therefore, the ride according to the invention is technically less complex, compared to rides having inversions and overhead drive patterns.

Thus, it is e.g. not necessary to provide holding devices, which retain the passenger in an overhead position in case of a stoppage of the vehicle caused by a malfunction. Additionally, the propulsion and brake devices can be simplified or omitted, which assure a controlled exit of the vehicle from an overhead position in case of a malfunction.

It is appreciated that the described ride does not have to be designed as a conventional roller coaster, thus it is also conceivable to use a so-called "inverted coaster", in which the guide device is disposed at the head side of the received passenger, as a baseline design and develop it further according to the invention.

BRIEF DESCRIPTION OF THE DRAWINGS

Additional features and advantages of the invention become apparent from the following description of particular embodiments with reference to the figures, showing in.

DESCRIPTION OF PREFERRED EMBODIMENTS

Figure 1:
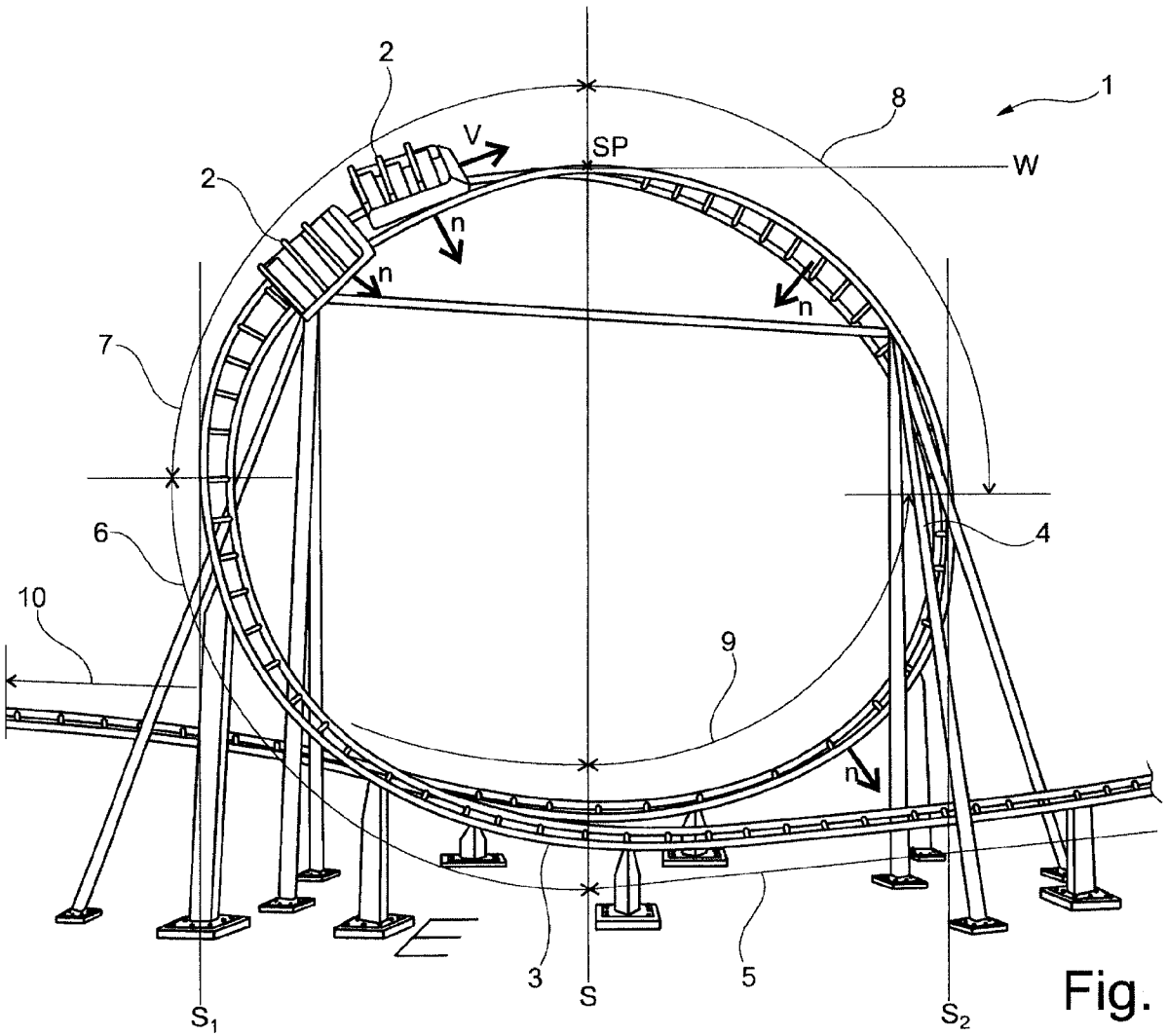
FIG. 1 a side view of a first embodiment of the ride according to the invention.

FIG. 1 shows a section of a ride according to the invention in a side view. The section comprises a drive pattern 1 in the form a loop, comprising end sections 5 and 10, extending approximately parallel with respect to one another. The track path approximately corresponds to the track path of a conventional looping.

The vehicles 2, in this case a train, comprised of two vehicles 2, are guided along the guide device 3, which is configured as a guide rail, in a movement direction v through the drive pattern 1. The track section 3 is thus supported by a support frame 4.

The guide device 3 comprises a first entry section 5, which constitutes a substantially horizontal entry of the vehicles 2 into the drive pattern 1. The vehicle 2 is substantially oriented in a horizontal position, when passing through an entry section 5, this means the normal vector n of the vehicle 2 is substantially oriented downward in the direction of the earth surface E, and is thus oriented in parallel and in the same direction with the vector of the weight.

The subsequent track section 6 substantially defines a quarter circle and extends to the vertical path tangent $s_1$. The track section 6 comprises an incline with positive curvature. The vehicle 2 enters the loop on its inside like in a conventional looping. The guide device 3, however, is wound along the track section 6, so that a vehicle 2 passing through the track section 6 and thus the normal vector n is rotated by approximately 90° towards one side between the beginning and the end of the section. The rotation is performed about an axis tangential to the guide device 3 or parallel to the movement direction v.

Another inclined track section 7 connects to the track section 6, in which the vehicle 2 is guided in turn from the vertical $s_1$ into the horizontal w. The rails 3 in the section 7 are wound in the same direction as in section 6 and rotate the vehicle 2 passing through the section 7 by another 90° laterally about an axis tangential to the guide device 3 or parallel to the movement direction v. Thus, the car 2, when passing the apex point SP, is in a substantially horizontal position, this means the normal vector n is oriented substantially vertically downward in the direction of the earth surface E.

In the declined track section 8, subsequently connecting to the inclined track section 7, the rail section 3 is also configured wound, so that the vehicle 2 when passing through the section 8 is tilted laterally by another 90°. Another tilt by 90° occurs when passing through the declined section 9, which connects to the section 8, and which transitions into a substantially horizontal exit section 10. Like in a conventional looping, the vehicle 2 exits the loop on its inside.

When passing through the entire drive pattern 1, the vehicle 2 has thus gone through a complete helical rotation, thus has been laterally rotated by a rotation angle of 360°. Thus, the car is in a horizontal position after passing through the loop. In said horizontal position the normal vector n is oriented downward in the direction of the earth surface E.

The normal vector n of the vehicle 2 in case of a horizontal alignment, this means in case of a horizontal alignment of the rails and without inversion or tilt, corresponds to the weight vector, however, it is disposed locally fixated with reference to the vehicle. It is always aligned perpendicular to the movement direction v, wherein the movement direction v extends tangential to the track course or the guide device 3.

Figure 2:
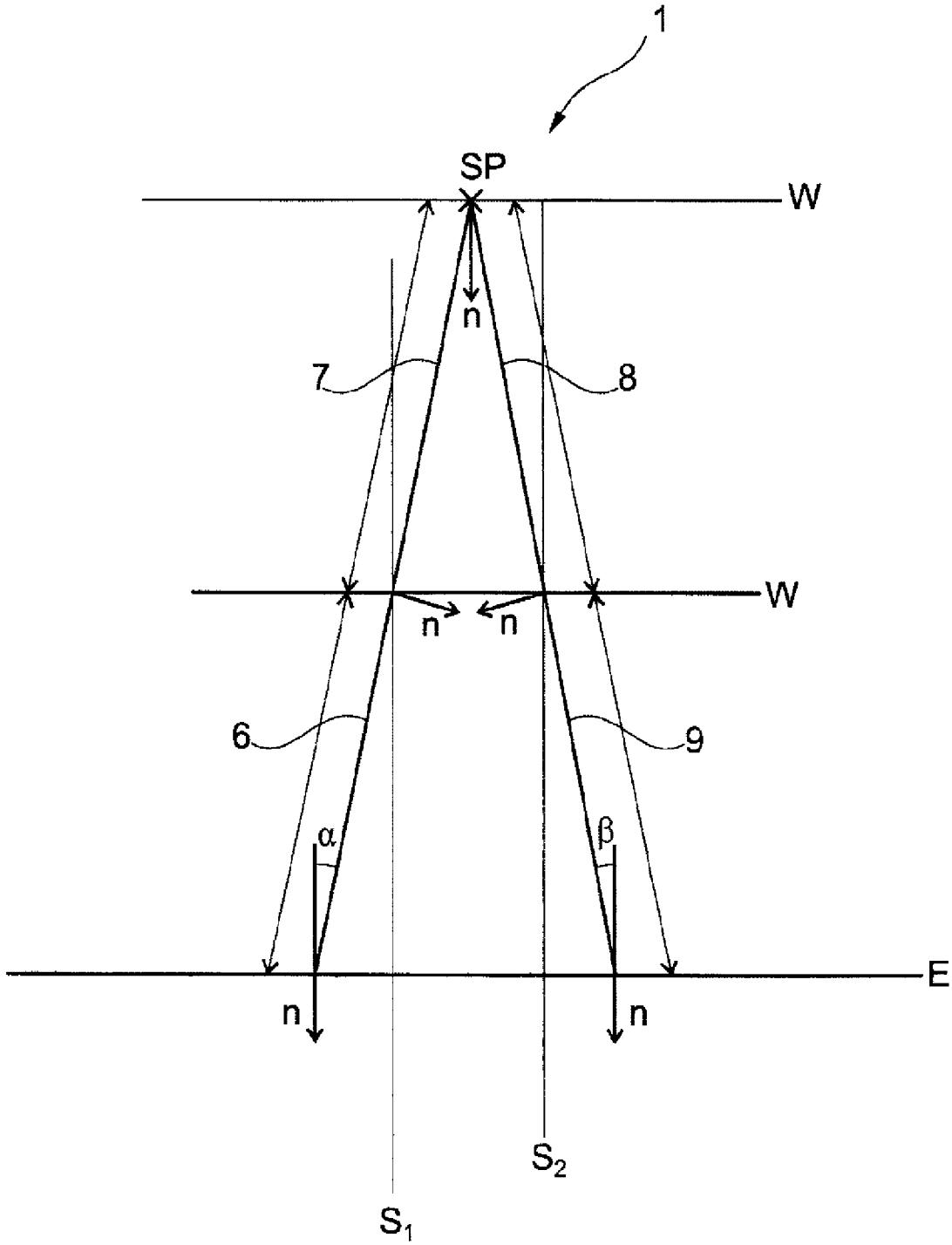
FIG. 2 a schematic view of a projection of the ride of FIG. 1 in the plane S.

FIG. 2 shows the drive pattern 1 of FIG. 1 schematically in a front view, projected into the plane S of FIG. 1. Thus, it is apparent that the track sections 6 and 7 are inclined at an angle α, relative to the vertical $s_1$, while the track sections 8 and 9 are inclined in opposite direction by an angle β, relative to the vertical $s_2$.

Through the arrows n, which symbolize the normal vector of the vehicle 2 at a certain position of the track, the normal vector is oriented vertically downward to the earth surface E when entering the track section 6. Through a suitable winding in the guide device 3 in the track section 6, the vehicle 2 is rotated outward up to the transition into the track section 7 by approximately 90° relative to an axis parallel to the movement direction v, so that the normal vector n in the transition portion from the section 6 to the section 7 points into the tilt direction, and is tilted downward by an angle α relative to the horizontal w towards the earth's surface E.

In the apex point SP, the vehicle 2 is rotated laterally in the section 7 by another 90° about an axis parallel to the movement direction v, so that the vehicle 2 at the point SP has gone through a lateral rotation of a total of 180°. Thus, the normal vector n is oriented vertically downward at the apex point SP, which is also the apex point of the driving pattern 1 in the present case.

In the track section 8, the vehicle is rotated by another 90°, thus up to a total angle of 270° in the transition portion to the section 8. The normal vector n is thus oriented in the direction into which the sections 8 and 9 are tilted, and is tilted downward by an angle β relative to the horizontal w in the direction of the earth surface E.

After passing through the subsequent track section 9, in which the vehicle 2 is rotated by another 90° about the axis parallel to the movement direction v, the vehicle 2 rotated laterally by a total of 360° is in turn in a regular non-inverted position, in which the normal vector n is oriented approximately vertically downward.

As evident from FIG. 2, the normal vector n, when passing through the drive pattern 1, is not oriented away from the earth surface E at all, this means it is inclined downward towards the earth surface E in each position of the vehicle 2 within the driving pattern 1. As a maximum, the normal vector n is oriented horizontal, its vertical component is, however, typically oriented in the direction towards the earth surface E.

Figure 3:
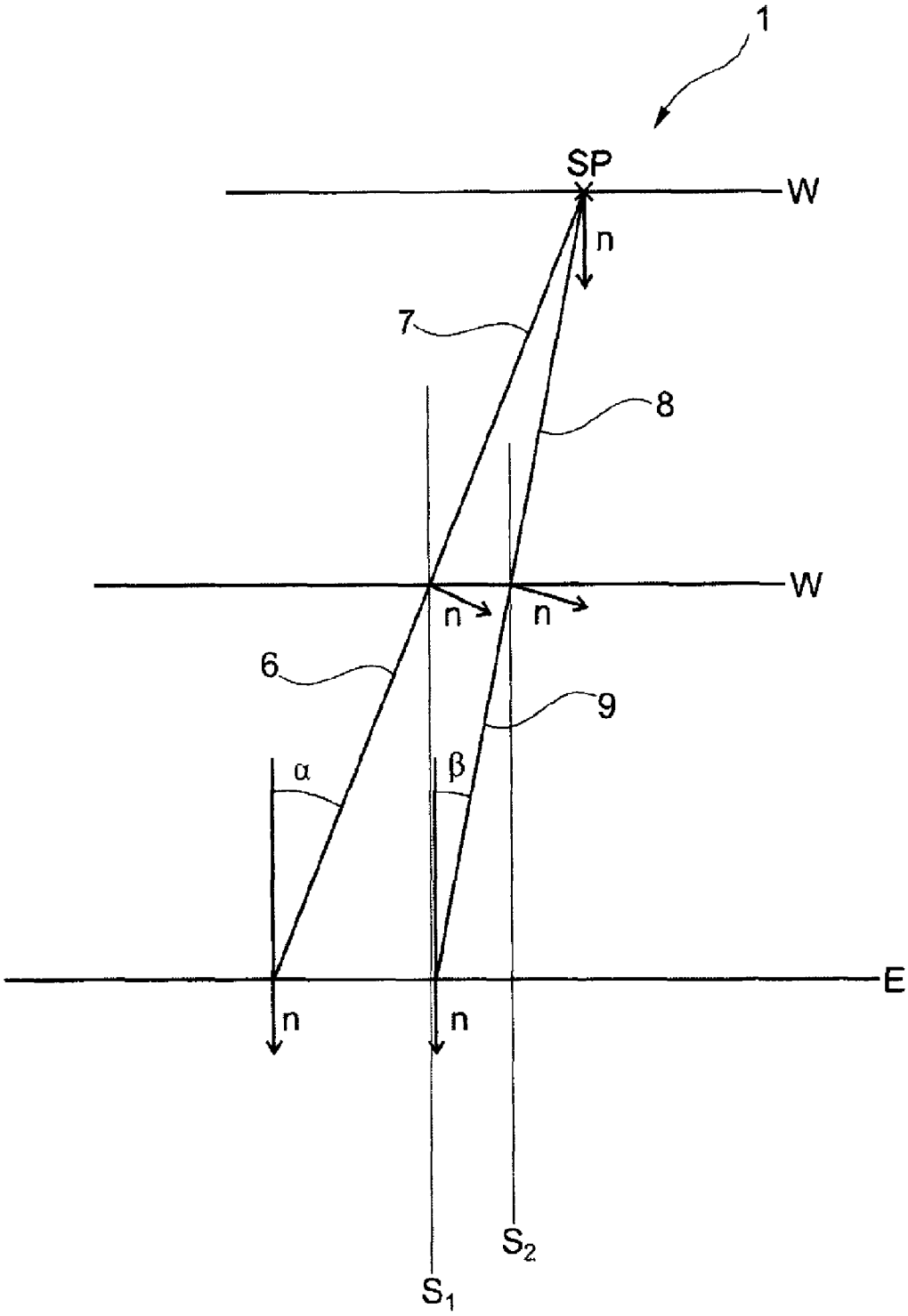
FIG. 3 a schematic view of a projection of an additional embodiment of the ride.

Another embodiment of the invention is schematically illustrated in FIG. 3. In this embodiment of the drive pattern 1, the track sections 6 and 7 are tilted by an angle α, the track sections 8 and 9 are tilted in the same direction by an angle β, which is less than α, relative to the vertical $s_1$ or $s_2$.

Also, in this embodiment of the drive pattern 1, the normal vector n, when passing through the drive pattern 1, does not point upward in any phase. This is accomplished when the sections 6, 7 and 8, 9 are inclined in the same direction by rotating the vehicle 2 in the sections 6 and 7 by a total angle of 180° about an axis parallel to the movement direction v. In section 8, the vehicle 2, and thus the normal vector n, in turn are rotated by approximately 90° about an axis parallel to the moving direction v, however, in the opposite direction as in the sections 6 and 7. In section 9, the vehicle 2 is rotated back by another 90° in the same direction as in section 8, so that the vehicle has performed a rotation of 180° after passing through the drive pattern 1 until the apex point SP is reached, and was subsequently rotated back again exactly by the same angle when reaching the horizontal entry track 10.

In both embodiments according to the FIGS. 2 and 3, it was accomplished that the normal vector n is always oriented in the direction of the earth's surface E, thus oriented with its vertical component in the same direction as the weight vector of the vehicle 2. Thus, the vehicle does not attain an overhead position when passing through the drive pattern 1. This means the guide device does not allow an inversion of the vehicle 2 within the drive pattern 1.

This means that an overhead safety with the associated complex technique can mostly be omitted without having to forego the riding pleasure when passing through a figure similar to a looping.

When passing through the drive pattern 1, the passenger experiences a new drive sensation, since within the drive FIG. 1 similar to a looping, a considerable elevation difference is covered within a short period of time, respectively during the incline and decline. The forces acting upon the passenger when entering the drive pattern 1 and when exiting the drive pattern 1, are comparable to the entry into a looping and to the exit from a looping. Through the curvature of the loop passed through on the inside, respective centrifugal forces act in said track portions in addition to the weight, so that the passenger is actually pressed into his seat in the sections 6 and 9. In the sections 7 and 8, on the other hand, the centrifugal force acts against the normal vector n of the vehicle 2, so that the passenger senses a force which is opposite to the normal component of the weight and which lifts him off his seat.

Figure 4A:
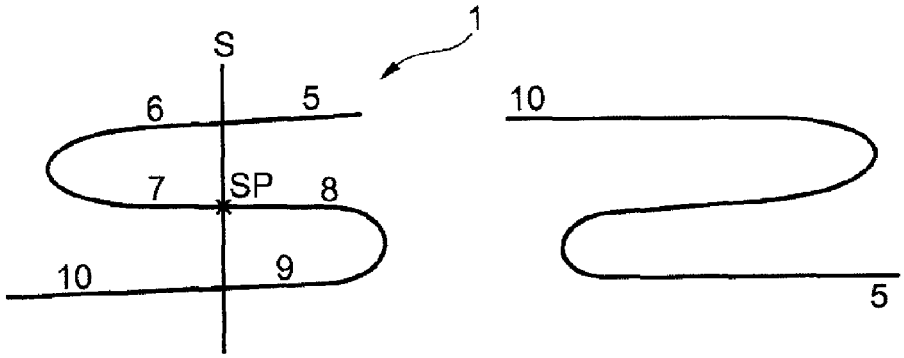
FIGS. 4*a*, 4*b*, 4*c* a schematic top view of the track path of drive patterns of rides according to the invention.
Figure 4B:
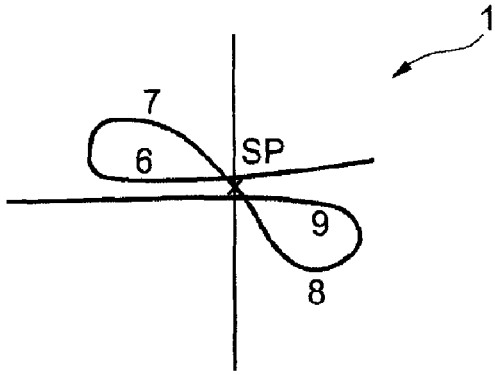
Figure 4C:
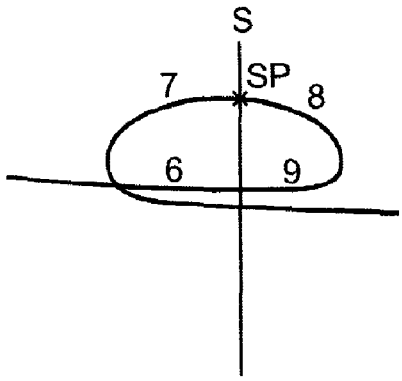

The FIGS. 4A, 4B and 4C show configurations of the drive pattern 1 of the ride according to the invention in a schematic top view. The apex points of the figures are thus designated SP.

The FIG. 4 can thus e.g. illustrate a view of the embodiment according to the FIGS. 1 and 2. The end sections 5 and 10 of the loop 1 are thus disposed offset and parallel. The inclined track sections 6, 7 and the declined track sections 8, 9 or their respective projections into the plane S are respectively tilted in the direction of the apex point SP, however, in opposite directions.

The embodiment shown in track section 1 according to FIG. 4*b*, however, comprises in the projection plane S on both sides symmetrical initially a partial section tilted away towards the outside from the apex point SP, and subsequently a partial section SP tilted towards the apex point SP, which transitions into the apex point SP.

The embodiment of the track portion 1 according to FIG. 4*c* corresponds e.g. to the embodiment according to FIG. 3. Both partial sections 6, 7 and 8, 9 or their respective projections into the plane S of the drive pattern 1 are disposed on the same side with reference to the apex point SP, and are thus tilted at different angles relative to the apex point SP from the same side.

Through the tilt of the drive pattern 1, which is projected onto the plane S, which is substantially perpendicular to the moving direction, during entry and exit from the driving pattern 1, it is assured that the normal vector n of the vehicle 2 is always tilted downward at angles which are greater or equal to the smallest tilt angle relative to the horizontal w. When a tilt is omitted, the drive pattern 1 can be configured with a horizontally oriented normal vector n in the portion of the vertical $s_1$ and $s_2$, which, however, otherwise points downward.

Figure 5:
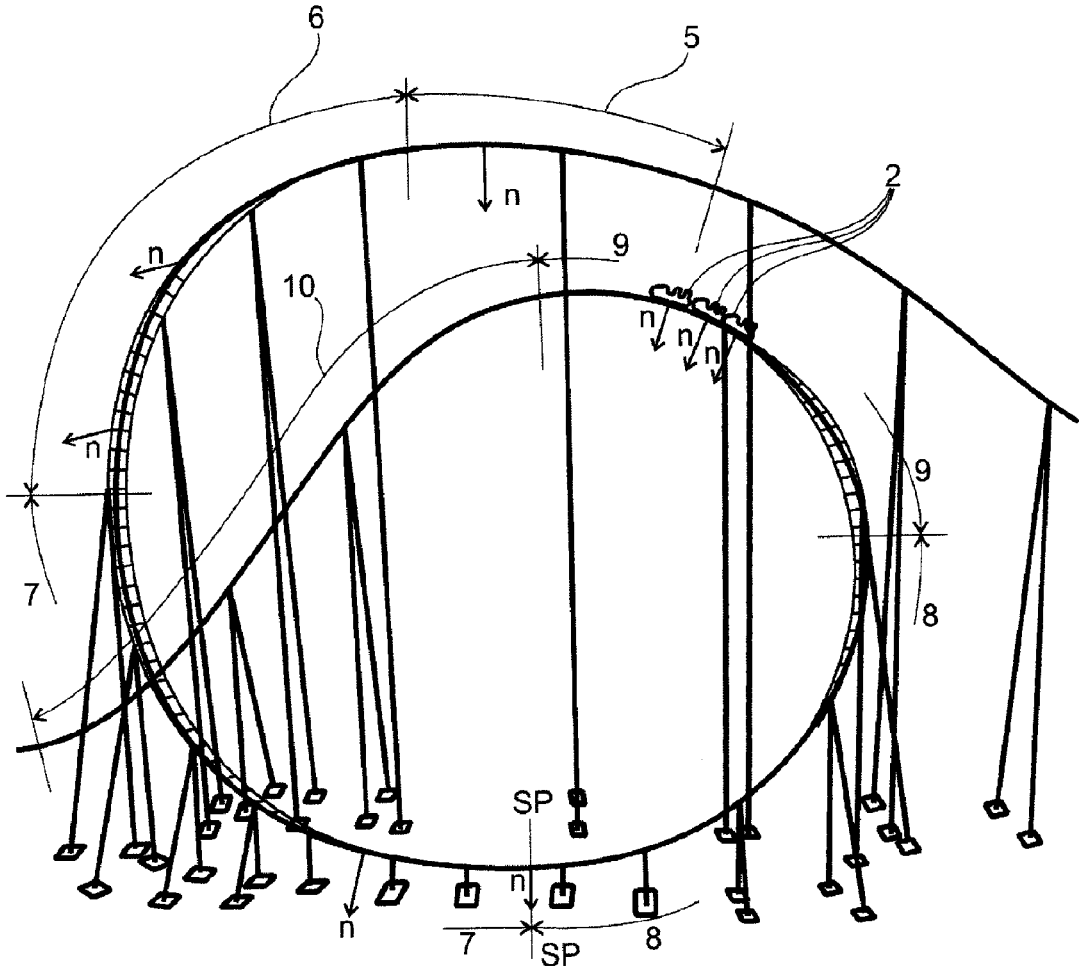
FIG. 5 a side view of an additional embodiment of the ride according to the invention.

Another embodiment of the invention is illustrated in FIG. 5. The drive pattern 1 in this case comprises an entry track section 5, in which the normal vector n of a vehicle 2 is oriented downward at a relatively steep angle toward the earth surface E. In the subsequent declining track section 6, two normal vectors n are indicated in an exemplary manner, which are also not oriented in upward direction, this means the vehicle 2 does not pass through an overhead position.

Like in the embodiments previously described, a vehicle 2 and its normal vector n, when passing through the sections 6 and 7, is rotated sideways by a total of 180° with reference to its movement direction, so that during a transition from section 7 into section 8, the normal vector n is oriented vertically downward to the earth surface E again.

Another lateral rotation by 180° is performed by the vehicles 2 when passing through the sections 8 and 9, so that they do not enter into an overhead position in any position along the drive track 3. The normal vectors n of the illustrated vehicles 2, which are arranged in a train, are oriented substantially vertically downward at the end of the track section 9. The vehicles 2 exit the drive pattern 1 through a declining exit track section 10.

A multitude of other loop shaped drive patterns is conceivable, in which an inclined and/or declined track section is provided, wherein the vehicle enters and exits on the inside of the loop, wherein the movement direction v, which is perpendicular to the normal vector n, changes by approximately 180° between entry and exit, thus is aligned at the exit of the track section, substantially opposite to the alignment at the entry of the track section, wherein, however, an overhead position of the vehicles passing through the driving pattern is prevented by a rotation of the normal vector about an axis aligned in parallel with the movement direction v. Examples for respective drive patterns are the so-called barrel roll, cork screw, etc.

Loops are also conceivable, whose entry and exit is disposed in the upper portion of the loop, like e.g. a so-called "dive loop". Furthermore, a driving pattern can be provided, in which initially an incline up to an apex point is provided as an entry into a downward extending loop. The exit after passing through the loop can be a declining track portion, which guides the vehicle downward again from the level of the apex point.

What is claimed is:

1. A ride for amusement parks and similar, comprising:

a drive track, comprising a guide device (3) for guiding at least one vehicle (2) along said guide device (3) in a movement direction (v); at least one vehicle (2), comprising a normal vector (n), fixated relative to the vehicle (2) and oriented perpendicular to the movement direction (v); and a drive pattern (1), comprising at least a first track section (6, 7), comprising an incline/decline, and a second track section (8, 9), comprising an incline/decline, comprising a prefix, which is inverse to the prefix of the incline/decline of the first track section (6, 7), wherein the first track section (6, 7) and the second track section (8, 9) are connected amongst one another, forming at least a partial section of a loop, wherein the guide device (3) is configured, so that the normal vector (n) in the first track section (6, 7) is rotated from an orientation to the outside or to the inside with reference to the loop at the entry into the first track section (6, 7) through a rotation of the normal vector (n) about an axis parallel to the movement direction (v) into an orientation to the inside or the outside, and the normal vector (n) in the second track section (8, 9) is rotated from the orientation to the inside or to the outside back to an orientation to the outside or to the inside, wherein the guide device (3) is furthermore configured, so that the normal vector (n) of the vehicle (2), when passing through the drive pattern (1), is not oriented upward, so that the vehicle does not assume an overhead position at any location in the drive pattern (1).

2. A ride according to claim 1, wherein the guide device (3) is configured, so that the normal vector (n) of the vehicle (2) at a track point (SP) between the first track section (6, 7) and the second track section (8, 9) is oriented substantially vertically downward to the earth surface (E).

3. A ride according to claim 2, wherein the track point (SP) between the first track section (6, 7) and the second track section (8, 9) forms an absolute and/or relative high point or an absolute and/or relative low point of the drive pattern (1).

4. A ride according claim 1, wherein the drive pattern (1) comprises an entry section (5) and/or an exit section (10), wherein the guide device (3) in the entry section (5) and/or in the exit section (10) is configured, so that the normal vector of a vehicle (2), passing through the respective section is oriented substantially vertically downward to the earth surface (E).

5. A ride according to claim 1, wherein the guide device (3) is configured, so that a vehicle (2) passing through the first track section (6, 7) is rotated in a first rotation direction about an axis parallel to the movement direction (v) of the vehicle (2), a vehicle (2) passing through the second track section (8, 9) is rotated in a second rotation direction about an axis parallel to the movement direction (v), wherein the first rotation direction and the second rotation direction are identical or opposite.

6. A ride according to claim 5, wherein the drive pattern (1) is configured, so that the movement direction (v) at the beginning of the first track section (6, 7) is oriented in particular at an angle of approximately 180° opposite to the movement direction at the end of the first track section (6, 7), and/or the movement direction (v) at the beginning of the second track section (8, 9) is oriented in particular at an angle of approximately 180° opposite to the movement direction (v) at the end of the second track section (8, 9).

7. A ride according to claim 1, wherein the first track section (6, 7) comprises a first partial track section (6) and a second partial track section (7), which form a substantially semicircular track path when connected to each other, and/or the second track section (8, 9) comprises a third partial track section (8) and a fourth partial track section (9), which form a substantially semicircular track path, when connected to each other.

8. A ride according to claim 7, wherein the guide device (3) is configured, so that a vehicle (2) passing through the first partial track section (6) and/or the second partial track section (7) and/or the third partial track section (8) and/or the fourth partial track section (9) is rotated respectively by an angle between 75° and 105°.

9. A ride according to one of the claim 8, wherein the guide device (3) is configured, so that the drive track in the transition portion from the first partial track section (6) to the second partial track section (7) and/or from the third partial track section (8) to the fourth partial track section (9) is tilted relative to a vertical in a plane defined by the movement direction (v) and the normal vector (n).

10. A ride according to claim 7, wherein the guide device (3) is configured, so that a vehicle (2) passing through the first partial track section (6) and/or the second partial track section (7) and/or the third partial track section (8) and/or the fourth partial track section (9) is rotated respectively by an angle of approximately 90°.

11. A ride according to claim 1, wherein the first track section (6, 7) is inclined and the second track section (8, 9) is declined, and the first and the second track section form a track path, shaped as a looping.

12. A ride according to claim 1, wherein the first track section (6, 7) forms a declining track section, the second track section (8, 9) forms an inclining track section.

13. A ride according to claim 1, wherein the drive pattern (1) does not comprise any overhead and/or inversion track sections over its entire course.

* * * * *